United States Patent [19]

Lambertz et al.

[11] Patent Number: 4,919,687

[45] Date of Patent: Apr. 24, 1990

[54] APPARATUS FOR THE PRODUCTION OF GAS CONTAINING HYDROGEN AND CARBON MONOXIDE FROM SOLID FUEL

[75] Inventors: Johannes Lambertz, Kerpen; Wolfgang H. Adlhoch, Swistal; Alfred G. Mittelstädt, Hürtz-Berrenrath; Wolfgang Hermann, Erftstadt-Gymnich, all of Fed. Rep. of Germany

[73] Assignee: Rheinische Braunkohlenwerke A.G., Cologne, Fed. Rep. of Germany

[21] Appl. No.: 353,132

[22] Filed: May 17, 1989

Related U.S. Application Data

[62] Division of Ser. No. 53,447, May 22, 1987, Pat. No. 4,852,994.

[51] Int. Cl.[5] ..... C10J 3/56

[52] U.S. Cl. ..... 48/62 R; 48/77; 422/111; 422/145; 422/117

[58] Field of Search ..... 48/197 R, 206, 62 R, 48/73, 77, DIG. 4; 406/85, 94, 95, 30; 262/373; 422/111, 145, 147; 34/57 A

[56] References Cited

U.S. PATENT DOCUMENTS

| | | | |
|---|---|---|---|
| 2,671,721 | 3/1954 | Gilliland | 48/DIG. 4 |
| 2,739,845 | 3/1956 | Berg | 406/95 |
| 2,873,145 | 2/1959 | Moser | 406/95 |
| 3,160,443 | 12/1964 | Harris et al. | 406/85 |
| 3,537,755 | 11/1970 | Schmidt | 406/95 |
| 3,751,214 | 8/1973 | Wenzel et al. | 406/85 |
| 3,871,711 | 3/1975 | Rusterholz | 406/94 |
| 3,874,739 | 4/1975 | Mitchell | 48/197 R |
| 3,957,457 | 5/1976 | Squires | 48/206 |
| 4,017,272 | 4/1977 | Anwer et al. | 48/197 R |
| 4,185,942 | 1/1980 | Bazan | 406/85 |

*Primary Examiner*—Peter Kratz

*Attorney, Agent, or Firm*—Seidel, Gonda, Lavorgna & Monaco

[57] ABSTRACT

In a process and apparatus for the production of gas containing hydrogen and carbon monoxide from a solid fuel in a fluidized bed, the solid particles contained in the product gas are separated off in a cyclone separator and recycled to the fluidized bed by way of a recycling conduit. The recycling conduit is provided with injection nozzles for introducing gas flows into the recycling conduit in a pulse-like manner in order to loosen up the particles therein. The gas flows may be introduced into the recycling conduit in displaced relationship in respect of time in such a way that, of two adjacent injection locations, gas is injected through the injection location which is arranged at a greater spacing from the reactor at a later time than at the injector location which is closer to the reactor.

4 Claims, 1 Drawing Sheet

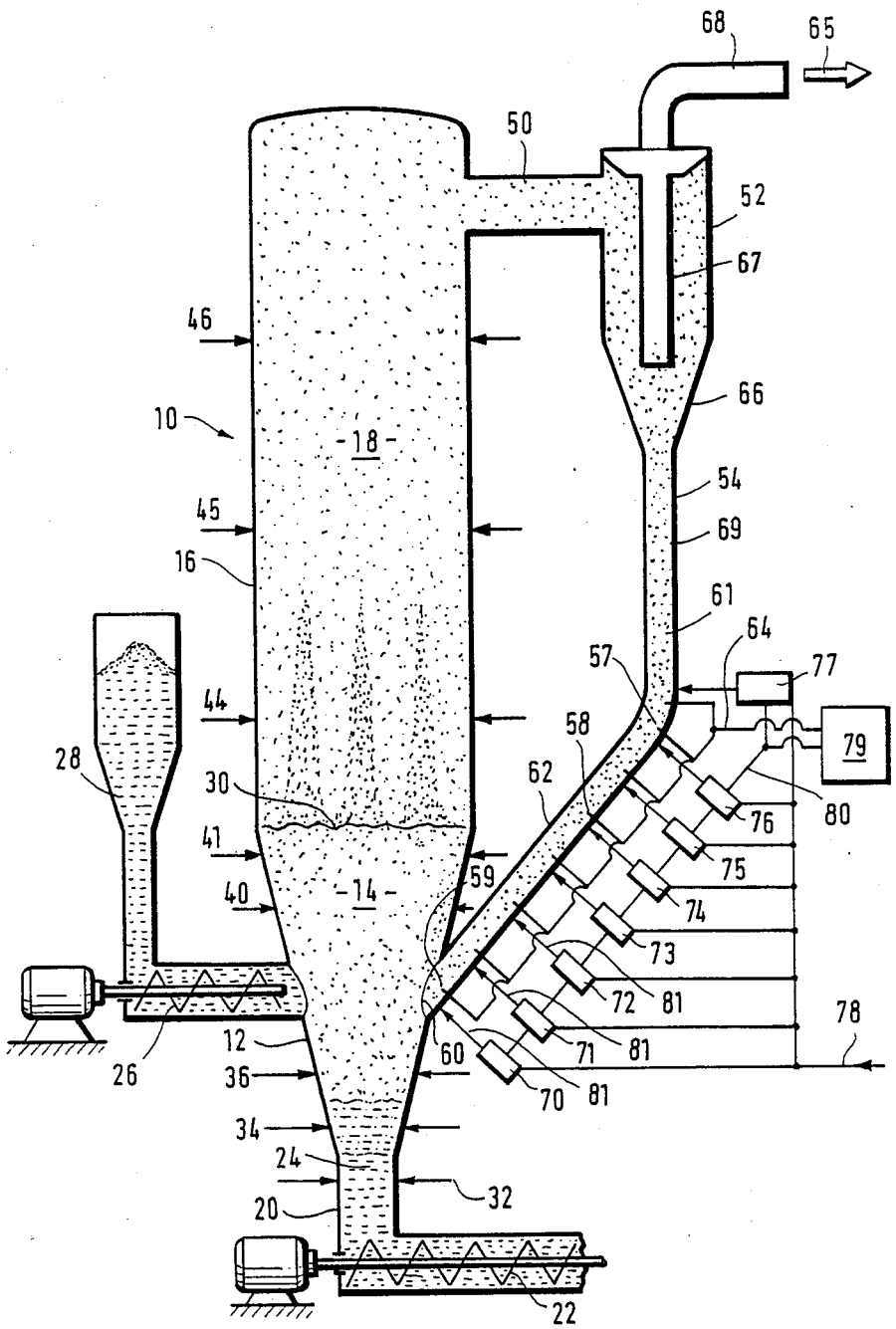
68
65
50
52
67
46
66
10
-18-
54
45
69
16
61
64
57
77
44
58
79
28
62
30
80
76
41
75
59
40
-14-
74
73
72
81
78
12
71
81
60
26
36
70
81
34
24
32
20
22

APPARATUS FOR THE PRODUCTION OF GAS CONTAINING HYDROGEN AND CARBON MONOXIDE FROM SOLID FUEL

This is a divisional of application Ser. No. 053,447, filed May 22, 1987, now U.S. Pat. No. 4,852,994.

BACKGROUND OF THE INVENTION

In one form of process for the production of gases containing hydrogen and carbon monoxide from solid fuels at elevated pressure in a fluidized bed using a gasification agent use is generaly made of a gasification reactor which has a lower conical portion in which the fuel to be gasified is put into a fluidized condition by the gasification agent. The fluidized bed which is produced in that way and within which the fuel particles are in a condition of constant movement has an upper and a lower boundary which are normally not sharply defined. The lower boundary is formed by a solid bed which is beneath the fluidized bed and which comprises finer and coarser solid gasification residues which are possibly sintered together. The solid gasification residues such as ash are drawn from the reactor at the lower end of the solid bed.

Together with gas which is produced within the fluidized bed, and any excess gasification agents that may be present, solid particles issue from the upper boundary surface of the fluidized bed, which boundary surface is in a condition of substantial movement. Those fuel particles pass into a generally cylindrical portion of the reactor which extends the conical lower portion thereof in an upward direction and within which a post-gasification space or zone is to be found. One or more gasification agents is or are also introduced into the post-gasification zone in order as substantially as possible also to gasify any fuel particles which are entrained out of the fluidized bed. The fuel particles and the gas produced are also in a condition of vigorous movement in the post-gasification zone, without however all particles falling back into the fluidized bed. On the contrary a large proportion of the particles together with the synthesis gas produced is discharged from the reactor at the upper end thereof, and those particles have to be at least in part separated out of the product gas in at least one separator which is normally in the form of a cyclone separator so that the synthesis gas leaves the separator in a condition of having undergone at least preliminary cleansing.

The solid particles which are separated off in the cyclone separator often still contain so much carbon that it is worthwhile recycling them to the reactor. With an increased feed of gasification agent or agents into the fluidized bed, it is even possible to achieve an operating condition which can be identified as an 'circulating fluidized layer'. In that situation, an upper boundary is no longer formed for the fluidized bed. On the contrary, so much gasification agent is introduced that the predominant proportion of fuel particles passes into the post-gasification space and from there into the separator and therefore must be recycled if an adequate degree of gasification effect is to be achieved.

The recycling conduit through which the solid particles which are separated off in the cyclone are returned into the reactor extends between the cyclone separator, more particularly generally between the lower part thereof, and the reactor, with the layout normally being such that the recycling conduit opens into the reactor in the region of the fluidized bed, that is to say, in the lower region of the reactor. In order to bridge over the horizontal spacing which is usually to be found between the separator and the reactor, the recycling conduit extends inclinedly, that is to say at an acute angle with respect to the vertical, at least in parts thereof. At any event the interior of the reactor, the separator and the recycling conduit form a coherent and intercommunicating system.

When recycling the solid materials, difficulties may arise because that system has a pressure drop such that the pressure decreases within the reactor in an upward direction, that is to say in the direction of the flow in the reactor gases. A further pressure drop occurs within the separator, the pressure in the separator in the region adjoining the recycling conduit for the solid material which is separated out of the gas being even lower than the pressure in the upper region of the reactor. On the other hand, at the end of the recycling conduit, remote from the separator, at which the recycling conduit communicates with the lower region of the reactor, the recycling conduit encounters the higher pressure obtaining within the reactor. As a result, different pressures are effective at the two ends of the conduit, with the two regions at the different pressures being more or less effectively screened off relative to each other by the solid material which accumulates in the conduit on its way back to the reactor. In a practical situation, that system involves confused and undefinable operating conditions within the recycling conduit, which have the result that the return flow of the solid material separated off in the separator into the reactor is prevented or at least adversely affected. That can result in a blockage in the recycling conduit as the solid particles therein become clogged up, particularly in the inclinedly extending portion of the conduit. Added to that is the fact that the above-indicated operating condition gives rise to pressure equalization procedures which cannot be monitored and which cannot be influenced and which also result in operational faults and defects and can even adversely affect the separation capability of the separator.

The risk that the solid material in the recycling conduit may form a blockage therein with the result that, after a short period of time, the progressively increasing length of the blockage becomes such that solid material accumulating in the recycling conduit reaches the separator, may also be attributed to the fact that the recycling conduit is of small diameter in comparison with the length thereof. The length of the conduit will generally be determined by the distance to be covered between the separator and the region of the fluidized bed reactor into which the solid material to be recycled is to be introduced. An increase in the diameter of the recycling conduit, which would help in counteracting the danger of blockages occurring, is not a viable proposition, as that would have an undesirable effect on the pressure and flow conditions in the entire installation, more specifically possibly even to such an extent that the system would no longer be operational. It should be appreciated that an increase in the diameter of the recycling conduit which, as already mentioned, generally communicates with the reactor in the lower region thereof, would have the result, with a given reactor diameter, that a larger proportion of the gaseous fluidization agent could pass into the lower region of the recycling conduit, possibly together with solid particles, so that the flow conditions which are intended to provide a direction of flow in the reactor upwardly therein, from there into the communicating conduit leading to the separator and from there by way of the recycling conduit back into the lower region of the reactor, could possibly be reversed or could at any event be subjected to an influence which would exclude orderly operation, with increasing recycling conduit diameter. In other words, having regard to the prescribed parameters involved, the recycling conduit must be of a suitably small diameter with a correspondingly high flow resistance in order to act as a kind of throttle means to prevent a pressure equalization effect from occurring as between the lower portion of the reactor and the separator.

As the absolute magnitude of the pressure drop in the system increases with increasing pressure within the reactor, the effects of the pressure drop on the material which is to be recycled from the separator into the reactor are correspondingly high in modern gasification reactors which are operated at a pressure of 20 bars or more.

SUMMARY OF THE INVENTION

An object of the present invention is to provide a process for the production of gas containing hydrogen and carbon monoxide from a solid fuel, which affords optimized production of the gas over the long term.

Another object of the present invention is to provide a process for the production of gas containing hydrogen and carbon monoxide from a solid fuel, such that, irrespective of the amount of solid particles recycled to the reactor, satisfactory continuous operation of the process still takes place.

Yet another object of the present invention is to provide a process for the production of gas containing hydrogen and carbon monoxide from a solid fuel wherein solid material and/or gas is substantially prevented from passing directly from the fluidized bed for gasification of the solid fuel into a separator for separating solid particles from the product gas.

Still another object of the present invention is to provide a process for the production of gas containing hydrogen and carbon monoxide from a solid fuel with controlled recycling of solid particles contained in the production gas to the gasification reactor, in dependence on the operating parameters involved.

A still further object of the invention is to provide an apparatus for producing a gas containing hydrogen and carbon monoxide from a solid fuel, with recycling of solid material entrained with the discharge flow of product gas from the reactor back into the reaction, under controlled recycling conditions.

In accordance with the invention, these and other objects are attained by a process and apparatus for the production of gas containing hydrogen and carbon monoxide from a solid fuel by a gasification procedure at elevated pressure in a fluidized bed, with a solid bed of solid gasification residues below the fluidized bed. Above the latter is a post-gasification space in which a supplemental gasification effect takes place. Gas produced is removed from the post-gasification space and passed through a separator for the separation therefrom of at least part of solid particles entrained in the flow of product gas. The solid particles are recycled to the reactor through a recycling conduit. Gas is injected into the conduit in a pulse-wise manner at at least one location thereon, to loosen up the solid material therein.

It has been found that an advantageous operating procedure of the process of the invention is one in which gas is injected into the recycling conduit at a plurality of locations which are disposed at spacings from each other in the longitudinal direction of the conduit, wherein such locations should preferably be arranged in that region in which the solid particles to be returned to the reactor tend to accumulate, being generally therefore that region which is adjacent to the reactor or the fluidized bed therein.

A part of the gas flows which are injected into the recycling conduit at different locations may be injected continuously, although it will be appreciated that pulse-like injection of at least a portion of the gas flows into the conduit gives the advantage that less gas has to be used to achieve the same loosening effect. That is also a matter of significance for the reason that, if an excessive amount of gas is injected into the recycling conduit and at least predominantly flows upwardly towards the cyclone separator, that will tend to reduce the separation capacity thereof. A mode of operation which has been found to be advantageous in that respect is one in which gas is injected into the recycling conduit continuously at the lowermost injection location which is therefore adjacent the communication of the recycling conduit with the reactor, while at all other locations which are at spacings thereabove, the gas is injected into the conduit intermittently, that is to say in a pulse-like manner.

A particularly desirable mode of operation is one in which the pulse-like injection of the gas at the injection location on the recycling conduit is effected for at least part of the time in displaced relationship in respect of time in such a way that, of first and second injection locations which are spaced from each other in the longitudinal direction of the recycling conduit, gas injection begins earlier at the respective injection location which is positioned closer to the reactor and possibly also terminates earlier at that location, than at the injection location which is positioned at a greater distance from the reactor. That provides that the column of solid material in the conduit is loosened up in an upwardly progressing manner, that is to say, it is loosened up in the opposite direction to the direction of flow of the solid material in the recycling conduit; that loosening effect has the result on the one hand that, beneath the region of the column of solid material which is loosened up by a gas impulse injection at a given position, the solid material has also already been loosened up and has possibly already flowed away through the conduit. On the other hand, by operating in that manner, the flow process within the recycling conduit may be satisfactorily influenced in respect of amount and time so that the speed at which the solid material flows from the recycling conduit into the reactor can be determined by way of controlling the gas pulses and in particular also the displacement thereof in respect of time. In that connection the amount of gas to be injected may be dependent on the amount of solid material which is to be found in the recycling conduit or to be returned to the reactor. Likewise, the number of gas pulses may also be dependent on the amount of solid material to be found in the recycling conduit or to be returned to the reactor. It is possible for the amount of gas which is to be injected at any given location to be increased by increasing the number of gas pulses per unit of time, although that dependency relationship is not a necessary one as it is readily possible for a given volume of gas to be distributed to a smaller or larger number of gas pulses, in which case the volume of gas injected per pulse varies.

The duration of a pulse may be 0.1 to 2 seconds and preferably 1 second. It is generally advantageous to provide a pause which is up to 1 second, and preferably 0.1 second, between two successive pulses. With the above-mentioned procedure for controlling the pulses in such a way that gas injection occurs in displaced relationship in respect of time at injection locations which are spaced from each other in the longitudinal direction of the recycling conduit, the time shift between the pulses of two adjacent injection locations may be so great that the pulse at the respective second injection location in terms of the sequence in time thereof begins only after the pulse in the preceding injection location has terminated. On the other hand it is also possible for the pulses to be caused to overlap each other in respect of time to a greater or lesser extent.

The speed or the amount of gas injected or the number of gas pulses may be controlled in suitable manner in dependence on an operating parameter, such as the pressure or the temperature, in the recycling conduit, while the injection gas used may be inert gas, for example $CO_2$ or nitrogen or recycled process gas.

Further objects, features and advantages of the invention will be apparent from the following description of a preferred embodiment thereof.

BRIEF DESCRIPTION OF THE DRAWING

The accompanying drawing is a diagrammatic view in longitudinal section through a Winkler fluidized bed reactor which operates under an increased pressure.

DESCRIPTION OF THE PREFERRED EMBODIMENT

Referring now to the drawing, it will be seen therefrom that a gasification process for producing a product gas which will contain in particular $H_2$ and CO is carried out in a reactor 10 comprising a lower region 12 which tapers conically downwardly and which contains a fluidized bed 14. In the illustrated embodiment, disposed adjoining the conical region 12 of the reactor in an upward direction is a cylindrical region 16 which contains a post-gasification zone indicated at 18. At its lower end, the reactor 10 goes into a short vertical shaft portion 20 having a conveyor and cooling screw 22 arranged at the lower end thereof. The shaft 20 and the screw 22 are provided for removing solid gasification residues predominantly containing ash, which accumulate below the fluidized bed 14 in the form of a solid bed 24.

Solid fuel to be gasified is introduced into the reactor 10 by means of a screw 26 from a supply container 28. In the illustrated embodiment the solid fuel flows into the fluidized bed 14 below the upper boundary thereof as indicated at 30. The fuel may be for example predried brown coal or lignite which has a water content of from 12 to 18% and a grain size of between 0 and 5 mm. It is also possible however to use other carbonaceous fuels, for example peat or coals which are more highly carbonized than brown coal or lignite.

The reactor 10 is provided with a pluarlity of feed conduits or nozzles for the introduction of gaseous agents which serve as gasification agents. Reference numeral 32 denotes the feed conduits at the lowermost positions, which open into the shaft 20 and are provided for introducing a gaseous agent for loosening up the solid bed 24. That agent may be an endothermic gasification agent, for example steam or $CO_2$, but is may also be an inert agent, for example nitrogen.

Provided in the tapering region 12 of the reactor 10 which is above the shaft 20 are feed conduits with nozzles, which are arranged in planes at vertical spacings from each other, for introducing gasification agents. The feed conduits 34 and 36 in the lower planes are provided for introducing gasification agents which preferably produce endothermic reactions, while oxygen-bearing gasification agents are introduced by way of the higher feed conduits 40 and 41.

Further conduits 44, 45 and 46 open into the post-reaction space or chamber 18. Gasification agents which normally produce exothermic and endothermic reactions are introduced into the post-reaction space 18 by way of those feed conduits 44, 45 and 46.

As mentioned above, fuel to be gasified is introduced into the reactor 10 in the region of the fluidized bed 14 by the screw 26. In the fluidized bed 14 the fuel particles are fluidized by the gasification agents, degasification products, steam produced by vaporization of water contained in the fuel, and the reaction products. The very small constituents, which are approximately in dust form, of the solid fuel introduced into the fluidized bed are entrained comparatively quickly by the gas which flows upwardly through the upper boundary 30 of the fluidized bed 14, into the post-reaction space 18 in which they undergo reaction at least in regard to a large part thereof. The extent to which gasification agents are introduced into the post-reaction space 18 by means of the feed conduits 44, 45 and 46 depends in particular on the amount of solid carbon which is to undergo reaction in the post-reaction space 18.

Heavy particles within the fluidized bed 14 sink through the latter and thus pass into the solid bed 24. Those heavy particles may be on the one hand coarser, predominantly carbonaceous particles which are too large to be carried by the gas which flows upwardly through the fluidized bed 14 while on the other hand, they may be particles which are excessively heavy in relation to their grain size and which accordingly sediment downwardly on to the solid bed 24, through the fluidized bed 14. Those particles may be both carbonaceous particles with a high ash content and also particles which consist exclusively of non-gasifiable substances.

The product gas 65 produced in the reactor 10 is drawn off through a conduit 50 which leaves the reactor 10 adjacent the upper end thereof and, after a precleaning operation in a separator illustrated as a cyclone separator 52, passed to downstream-disposed items of equipment, for example for gas cleaning purposes. The solid particles which are separated off in the cyclone separator 52 and which generally still contain carbon pass by way of the lower outlet 66 of the cyclone separator into a recycling conduit indicated generally at 69, the lower portion 62 of which, extending in an inclined position, is connected to the reactor 10 in the region of the fluidized bed 14, at the opening 60. The gas 65 from which the separated-out solid particles have been removed leaves the cyclone separator 52 through a dip pipe 67 and by way of a conduit 68.

The recycling conduit 69 for the solid particles which are separated off in the cyclone separator 52 opens into the reactor 10 approximately at the level of the feed screw 26 and opposite thereto. The solid particles separated out of the product gas from the reactor flow out of the lower region of the cyclone separator at 66 downwardly into the conduit 69 whose cross-section is filled by the solid particles in the region 62 between the opening 60 where it communicates with the reactor 10, and approximately the level 61. The column of solid particles which is thus formed within the conduit 69 represents a barrier which prevents solid particles and gas from passing from the reactor 10 through the conduit 69 directly into the region of the cyclone separator 52.

As the recycling conduit 69 is of comparatively small cross-section and as moreover the pressure obtaining in the region of the cyclone separator 52 is markedly lower than the pressure in the fluidized bed 14 so that a pressure drop which acts in opposition to the force of gravity exists between the opening 60 of the conduit 69 into the reactor 10 on the one hand and the cyclone separator 52 on the other hand, there is no guarantee, without special steps being taken, that, as considered over prolonged periods of time, as large an amount of solid particles may pass into the reactor 10 from the recycling conduit 69 at the bottom, as pass out of the cyclone separator 52 into the recycling conduit at the top. Irrespective of the above-mentioned pressure drop, the small cross-section of the recycling conduit 69 means that it is also necessary to consider the possibility of the particles in the conduit 69 forming a blockage therein so that, even when a column of solid material is formed in the conduit 69, the height and thus the weight of which is sufficient to compensate for the pressure drop, there might be no guarantee that the solid particles forming that column would flow away into the reactor 10 in a satisfactory and undisturbed manner.

To provide for the return flow of the solid particles from the conduit into the reactor 10, as is necessary for proper operation of the system, the apparatus has nozzles 81 for injecting at least one gaseous agent into the recycling conduit 69. The nozzles 81 are arranged at spacings from each other in the longitudinal direction of the conduit 69 and are supplied by way of interposed control valves 70–77, from a common pressure medium source 78, with a gas which may be for example $CO_2$ or recycled product gas which is branched off the gas flow 65 at a suitable location. The control valves 70–77 are actuated by a common controller 79 to which they are connected by way of a line 80. The pressure level of the gas 78 will be somewhat higher than the pressure in the fluidized bed 14. The controller 79 controls the individual valves 70–77 and in respect of each thereof produces for a short time a flow of gas of a given amount, which passes by way of the respective nozzles 81 into the lower region of the conduit 69, in a pulse-like manner. The operating procedure may be such that the valve 70–77 successively produce brief gas pulses whereby firstly a gas pulse is introduced through the valve 70 and its associated nozzle 81 into the mouth opening 60 of the conduit 69, and thereafter gas pulses are introduced ito the conduit 69 through the other valves 71–77 in time-shifted manner, the spacing in respect of time from the first gas pulse which is introduced through the valve 70 increasing with increasing distance of the respective valve from the first valve 70. In that way the solid material accumulated in the conduit 69 is progressively loosened up in an upward direction in the conduit so that the particles flow downwardly under the effect of the weight thereof and pass into the fluidized bed 14, while on the other hand the conduit 69 is not caused to empty abruptly, so that the conduit 69 always retains such an amount of solid material therein that that material acts as a barrier with respect to the interior of the reactor 10 and thus ensures that gas and solid material cannot pass from the interior of the reactor 10 directly into the cyclone separator 52 through the recycling conduit 69.

The above-described mode of operation may be used, depending on the amount of solid material passing into the conduit 69 from the cyclone separator 52, in such a way that, as soon as the gas pulse through the valve 77 which is at the uppermost position has been introduced into the conduit 69, the cycle begins again, commencing with the gas pulse which is introduced through the valve 70.

If necessary or appropriate, it is also possible, after actuation of the last valve 77, to leave a longer pause before the next pulse cycle is begun by actuating the valve 70. That depends on the amount of solid material which passes from the cyclone separtor 52 into the conduit 69, and thus the speed at which the solid particles have to be introduced into the reactor 10 from the conduit 69. It is also possible for the pulse cycle to be caused to take its effect not over the entire number of valves 70–77 provided, but instead for example for gas pulses to be introduced into the conduit 69 only through the valves 70–75. The way in which the procedure is specifically carried out depends on the respective parameters involved, in particular the amount of solid material which accumulates in the conduit 69 per unit of time.

Actuation of the individual valves 70–77 may be effected in a simple manner by way of the controller 79 with which there are associated temperature sensors 57–59 for detecting the temperature in the conduit 69 and which are associated with that region of the conduit 69 in which the nozzles 81 of the valves 70–77 are to be found. With a high rate of through-put of solid material through the conduit 69, a temperature level occurs therewithin, which is not substantially below the temperature level within the fluidized bed 14 and is usually in the range of between 800° and 1000° C. If the return flow of solid material in the conduit 69 is slowed down, it is then possible to detect a direct drop in temperature to lower values at the temperature measuring locations of the sensors 57–59. That change in temperature shows that the recycling of the solid material from the conduit 69 into the fluidized bed 14 is excessively slow. Signals which are supplied to the controller 79 by the temperature measuring sensors 57–59 by way of the line 64 cause the controller to accelerate the sequence of gas pulses. In the reverse situation, that is to say when less solid material is introduced into the conduit 69 from the cyclone separator 52 and accordingly less solid material is to be introduced into the fluidized bed 14 at the lower end of the conduit 69, the sequence of gas pulses can be slowed down.

In a modification of the above-described mode of operation, it is also possible for for example the lower valve 70 to be left permanently in the open position in operation of the assembly so that a continuous flow of gas passes into the conduit 69 just upstream of the mouth opening 69 of the conduit 69 into the reactor.

Instead of the valves 70–77 or selected ones thereof being actuated on the basis of temperature, it is possible for the valves and therewith the gas pulses produced thereby to be acutated on the basis of the pressure obtaining at the respective locations on the recycling conduit. Which of the two options, pressure or temperature, is preferred, depends on the respective operating parameters involved.

The nozzles 81 may comprise conventional materials which are resistent to high temperature while commercially available pneumatic switching valves may be used to provide the valves 70–77. It is desirable for them to be arranged at spacings which are as uniform as possible from as well as along the conduit 69; for example from one to three nozzles per meter of recycling conduit may be used, and the spacing between the valves may be of the order of magnitude of 10 centimeters while the diameter of the conduit 69 may be for example 20 centimeters. The nozzles 81 are normally arranged predominantly in the region of the recycling conduit which does not extend vertically.

The amount of gas to be injected into the recycling conduit is low. Thus the quantitative relationship between the gas to be injected and the product gas produced in the gasification reactor 10 may be about 2:500.

It will be seen from the foregoing that, substantially irrespective of the amount of solid particles to be recycled from the separator to the reactor, satisfactory continuous operation of the gasification reactor can be generally ensured, avoiding solid material and/or gas passing directly from the fluidized bed into the recycling conduit and thence to the separator as, irrespective of other adverse effects on operations, that could impair the separation capability of the separator. In spite of the comparatively small cross-section of the recycling conduit, the solid particles to be recycled can be returned to the reactor controllably in dependence on the respective parameters involved, for example gasification pressure, amount of particles and time.

It will be appreciated that the above-described invention has been specifically set forth only by way of example and illustration thereof and that various modifications and alterations may be made therein.

What is claimed is:

1. Apparatus for the production of a gas containing hydrogen and carbon monoxide from a solid fuel material comprising:

(a) a gasification reactor constructed to operate under an elevated internal pressure and providing a fluidized bed portion for accommodating a fluidized bed of said solid fuel material and a post-reaction chamber above said fluidized bed portion for post-gasification reaction of material leaving said fluidized bed portion of said reactor;

(b) means for introducing said solid fuel material into said reactor;

(c) means for producing said fluidized bed of said solid fuel material in said fluidized bed portion of said reactor and for effectuating gasification of said solid fuel material in said fluidized bed;

(d) means for separating from product gas produced in said reactor at least a portion of solid particle material entrained by the flow of said product gas upwardly from said fluidized bed portion through said post-reaction chamber;

(e) means for discharging said product gas from said separating means;

(f) a recycling conduit having a first end communicating with said separation means and a second end communicating with said reactor, for recycling said separated-off solid material from said separating means to said reactor;

(g) means for introducing gas into said recycling conduit at a plurality of spaced apart locations along a portion of said recycling conduit including a plurality of nozzles, each said nozzle being spaced apart from the next nozzle along a longitudinal axis of said conduit, said plurality of nozzles beginning at a location adjacent said second end of said recycling conduit to loosen up said separated-off solid material therein, thereby maintaining a flow of said separated-off solid material through said recycling conduit; and (h) means for controlling the injection of gas into said recycling conduit and constructed to provide for successive pulse-wise injection of said gas such that an initial pulse of gas begins at a location adjacent said reactor at said second end of said recycling conduit and successively runs along said plurality of said spaced apart nozzles to an upstream location remote from said reactor.

2. Apparatus as set forth in claim 1 wherein said control means includes means for actuating the injection of gas in dependence on an operating parameter in said recycling conduit.

3. Apparatus as set forth in claim 2 wherein said actuating means include temperature sensing means operable to sense the temperature in said recycling conduit as said operating parameter.

4. Apparatus as set forth in claim 2 wherein said actuating means comprises pressure sensing means operable to sense the pressure in said recycling conduit as said operating parameter.

* * * * *